US007071879B2

(12) United States Patent
Strickland

(10) Patent No.: US 7,071,879 B2
(45) Date of Patent: Jul. 4, 2006

(54) DIELECTRIC-RESONATOR ARRAY ANTENNA SYSTEM

(75) Inventor: Peter C. Strickland, Ottawa (CA)

(73) Assignee: EMS Technologies Canada, Ltd., Ottawa (CA)

( * ) Notice: Subject to any disclaimer, the term of this patent is extended or adjusted under 35 U.S.C. 154(b) by 21 days.

(21) Appl. No.: 10/858,262

(22) Filed: Jun. 1, 2004

(65) Prior Publication Data

US 2005/0264449 A1 Dec. 1, 2005

(51) Int. Cl.
*H01Q 1/38* (2006.01)

(52) U.S. Cl. ..... 343/700 MS; 343/705; 343/757

(58) Field of Classification Search ..... 343/700 MS, 343/705, 754, 757
See application file for complete search history.

(56) References Cited

U.S. PATENT DOCUMENTS 5,512,906 A * 4/1996 Speciale ..... 342/375
5,764,185 A 6/1998 Fukushima et al.
5,940,036 A * 8/1999 Oliver et al. ..... 343/700 MS
5,952,972 A 9/1999 Ittipiboon et al.
5,982,333 A 11/1999 Stillinger et al.
5,990,838 A 11/1999 Bhattacharyya
6,111,542 A 8/2000 Day et al.
6,183,360 B1 2/2001 Kato et al.
6,225,961 B1 5/2001 Benjauthrit
6,281,845 B1 8/2001 Ittipiboon et al.
6,339,707 B1 1/2002 Wainfan et al.
6,404,401 B1 6/2002 Gilbert et al.
6,452,565 B1 * 9/2002 Kingsley et al. ..... 343/873
6,501,439 B1 12/2002 Keilen
6,570,467 B1 5/2003 Walker et al.
6,628,242 B1 9/2003 Hacker et al.
6,646,605 B1 11/2003 McKinzie, III et al.
6,653,985 B1 11/2003 Sikina et al.
6,768,454 B1 * 7/2004 Kingsley et al. ..... 342/368
6,816,118 B1 * 11/2004 Kingsley et al. ..... 343/700 MS
2002/0014996 A1 2/2002 Keilen
2002/0070820 A1 6/2002 Walker et al.

(Continued)

FOREIGN PATENT DOCUMENTS

EP 0 598 656 B1 5/1994

(Continued)

OTHER PUBLICATIONS

Petosa et al, "Bandwidth Improvement for a Microstrip-Fed Series Array of Dielectric Resonator Antennas," Electronics Letters, Mar. 28, 1996. vol. 32, No. 7, pp. 608-609.

(Continued)

*Primary Examiner*—Tho Phan

(57) ABSTRACT

A dielectric resonator element array (DRA) antenna system that is small, compact, has high gain in the direction of intended communication, minimized interference in unintended directions of communication and a wide bandwidth. The antenna system comprises a ground plane, a feed structure, a beam shaping and steering controller, a mounting apparatus, an array of dielectric resonator elements and a radome that is close to or in contact with the array. The mounting apparatus preferably is configured so as not to appreciably increase the size of the system when mounted. The controller receives and processes information relating to one or more of object latitude, longitude, attitude, direction of travel, intended direction of communication and unintended directions of communication. The controller processes this information and determines excitation phase for the array elements.

21 Claims, 8 Drawing Sheets

U.S. PATENT DOCUMENTS

| | | | |
|---|---|---|---|
| 2002/0087992 | A1 | 7/2002 | Bengeult et al. |
| 2002/0105461 | A1 | 8/2002 | Fukushima et al. |
| 2002/0140608 | A1 | 10/2002 | Zaghloul et al. |
| 2002/0167449 | A1 | 11/2002 | Frazita et al. |
| 2002/0196193 | A1 | 12/2002 | Butler et al. |
| 2003/0042997 | A1 | 3/2003 | Baik et al. |
| 2003/0083063 | A1 | 5/2003 | Wang et al. |
| 2003/0151548 | A1 | 8/2003 | Kingsley et al. |
| 2003/0184478 | A1 | 10/2003 | Kingsley et al. |

FOREIGN PATENT DOCUMENTS

| | | | |
|---|---|---|---|
| GB | 2 268 626 | A | 1/1994 |
| GB | 2 360 134 | A | 9/2001 |
| GB | 2 386 475 | A | 9/2003 |
| GB | 2 387 035 | A | 10/2003 |
| JP | 2001-7637 | | 1/2001 |
| JP | 2001-326506 | | 11/2001 |
| JP | 2002-271133 | | 9/2002 |
| WO | WO 98/19359 | | 5/1998 |
| WO | WO 00/14826 | | 3/2000 |
| WO | WO 01/31746 | A1 | 5/2001 |
| WO | WO 01/69721 | A1 | 9/2001 |
| WO | WO 01/69722 | A1 | 9/2001 |
| WO | WO 02/49154 | A1 | 6/2002 |
| WO | WO 02/058190 | A1 | 7/2002 |
| WO | WO 03/007425 | A1 | 1/2003 |
| WO | WO 03/019718 | A1 | 3/2003 |
| WO | WO 03/066071 | A1 | 8/2003 |
| WO | WO 03/079490 | A1 | 9/2003 |
| WO | WO 03/081714 | A1 | 10/2003 |
| WO | WO 03/081719 | A1 | 10/2003 |
| WO | WO 03/083991 | A1 | 10/2003 |
| WO | WO 03/098737 | A1 | 11/2003 |
| WO | WO 03/098738 | A2 | 11/2003 |

OTHER PUBLICATIONS

Drossos et al., "Two-Element Endfire Dielectric Resonator Antenna Array," Electronics Letters, Mar. 28, 1996, vol. 32, No. 7, pp. 618-619.

Petosa et al., "Investigation of Various Feed Structures for Linear Arrays of Dielectric Resonator Antennas," Canadian Crown, 1995, pp. 1982-1985.

Lee et al., "Bandwidth Enhancement of Dielectric Resonator Antennas," IEEE, 1993, pp. 1500-1503.

Petosa et al., "Low Profile Phased Array of Dielectric Resonator Antennas," IEEE, 1996, pp. 182-185.

CRC's Technologies, "Overview of Advanced Antenna Technology," http://www.crc.ca/en/html/crc/home/tech_transfer/antenna_overview.

CRC, "Broadband Nonhomogenous Multi-Segmented Dielectric Resonator Antenna System," http://www.crc.ca/en/html/crc/home/tech_transfer/10103.

CRC, "Broadband Circularly Polarized Dielectric Resonator Antenna," http://www.crc.ca/en/html/crc/home/tech_transfer/10102.

CRC's Technologies, "CRC's Technologies—Terrestrial Wireless Systems," http://www.crc.ca/en/html/crc/home/tech_transfer/tech_tran_terr.

WO PCT Search Report, filed Dec. 23, 2005, EMS Technologie.

* cited by examiner

DIELECTRIC-RESONATOR ARRAY ANTENNA SYSTEM

TECHNICAL FILED OF THE INVENTION

The invention relates to antennas and, more particularly, to a dielectric-resonator array antenna system that is small and low in profile, while also having a wide bandwidth, accurate beam steering and efficient radiation.

BACKGROUND OF THE INVENTION

Aeronautical antenna systems for satellite communications can be very large in area, which results in increased air drag and more weight for the aircraft on which the antenna system is mounted. Increased drag and weight result in a reduction in the aircraft's flying range, increased fuel consumption and corresponding higher aircraft operational costs. Large antenna systems can also increase lightning and bird strike risks, as well as degrade the visual aesthetics of the aircraft.

Communications with satellites using physically small antenna arrays requires an exceptionally low noise temperature and high aperture efficiency. In aeronautical applications, the antenna should also be narrow and have a low profile in order to minimize drag and not deviate excessively from the contours of the aircraft. Conventional antenna systems for aeronautical satellite communications (SATCOM) applications, in the lower microwave frequency bands, typically utilize either drooping-crossed-dipole elements or microstrip patch radiators. The configuration of crossed-dipole elements is relatively tall, which results in high drag.

The microstrip patch element has a relatively low profile, but has both a narrow beamwidth and narrow bandwidth, which restrict the antenna's performance. The narrow beamwidth of the patch element results in excessive gain reduction and impedance mismatch when the array beam peak is scanned toward the aircraft horizon with the antenna mounted on the top of the fuselage. The narrow bandwidth of the patch radiator makes the impedance mismatch more catastrophic at extreme scan angles. These effects reduce the gain of the antenna system, thus requiring that the antenna have a larger antenna footprint and overall larger size.

In addition, conventional antenna arrays have beam steering systems for creating beam radiation patterns that use simple look-up tables for determining element phase settings for a given beam position relative to the airframe. This current approach to determining element phase settings does not minimize interference with other satellites on the geosynchronous arc. Consequently, the size of the antenna must be relatively large in order to achieve a desired degree of isolation against satellites other than the one with which communication is desired.

Some existing high gain phased array antenna systems for aeronautical Inmarsat applications include the CMA-2102 antenna system by CMC Electronics, the T4000 antenna system by Tecom, the HGA 7000 antenna system by Omnipless, and the Airlink and Dassault Electronique Conformal antenna system by Ball Aerospace. The CMA-2102 and Tecom T4000 antenna systems are conventional drooping crossed dipole arrays of large size that use conventional steering algorithms and conventional mounting techniques. The Omnipless HGA 7000 antenna system has not yet been sold commercially and is of unknown construction. The Ball Aerospace Airlink and Dassault Electronique conformal antenna systems are conventional microstrip patch arrays that use conventional steering algorithms and conventional mounting techniques.

A need exists for a small antenna system that can be mounted on a small surface area, and which has high gain in directions of intended communication and low interference in other directions. A need also exists for a small, compact antenna system that has high beam-steering accuracy, wide bandwidth and very efficient radiation.

SUMMARY OF THE INVENTION

The invention provides a dielectric resonator element array (DRA) antenna system that is small, compact, has high gain in the direction of intended communication, minimized interference in unintended directions of communication and a wide bandwidth. The antenna system comprises a ground plane, a feed structure, a beam shaping and steering controller, a mounting apparatus, an array of dielectric resonator elements and a radome that is close to or in contact with the array. The mounting apparatus preferably is configured so as not to appreciably increase the size of the system when the antenna system is mounted on the object. Therefore, the radome does not appreciably increase drag and does not adversely affect the aesthetic appearance of the object on which it is mounted.

The radome preferably is closer than $\frac{1}{4}\lambda$ to the array elements. Because of this, effects of the radome on the radiation patterns generated by the antenna system preferably are taken into account by the beam shaping and steering algorithm executed by the beam steering controller. The controller receives information relating to one or more of object latitude, longitude, attitude, direction of travel, intended direction of communication and unintended directions of communication. The controller processes this information in accordance with the beam shaping and steering algorithm and determines excitation phase for the array elements. The controller then outputs signals to the feed structure to cause the proper phase excitations to be set.

These and other features and advantages of the present invention will become apparent from the following description, drawings and claims.

DETAILED DESCRIPTION OF EXEMPLARY EMBODIMENTS

Figure 1:
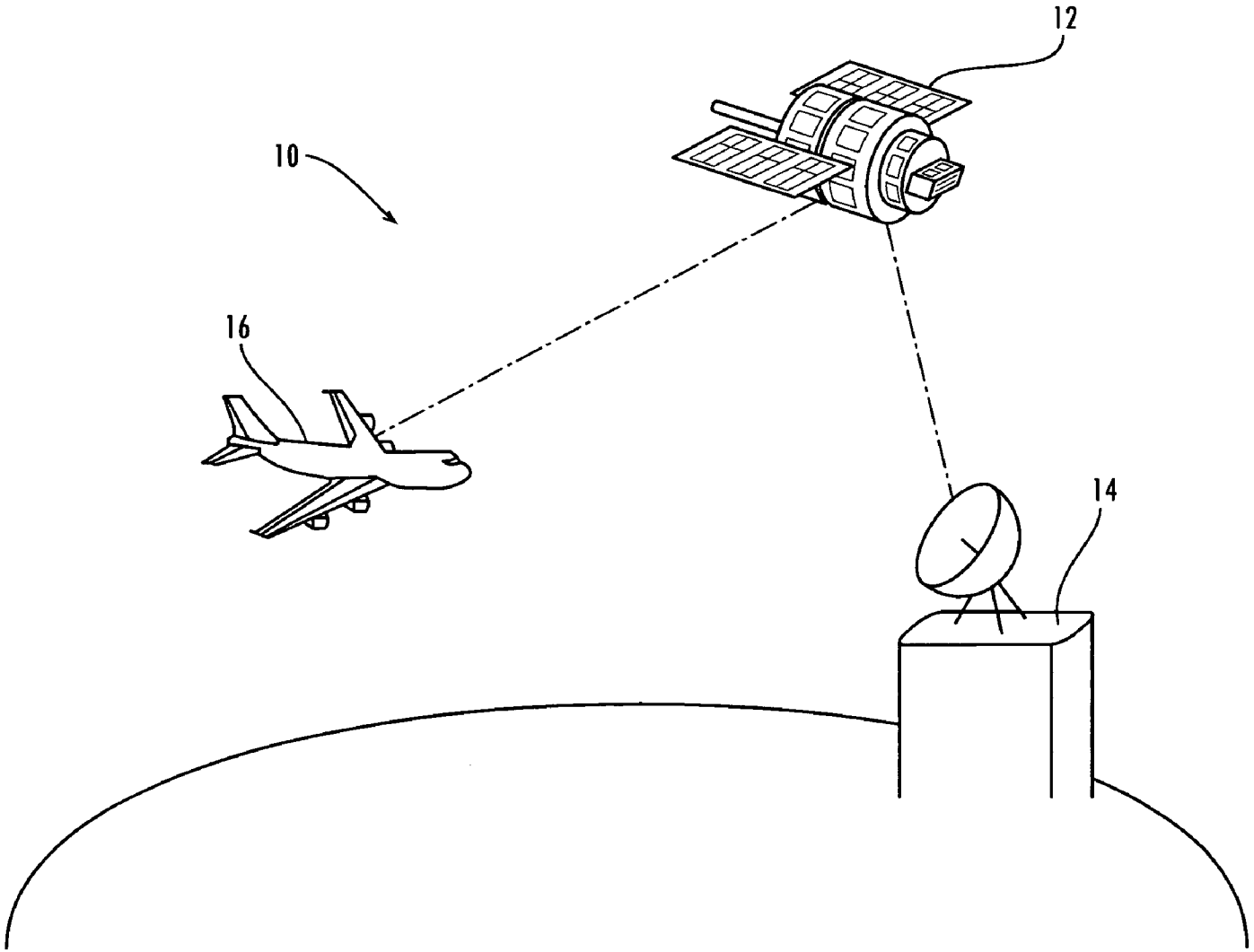
FIG. 1 is a pictorial illustration of the DRA antenna system of the invention being employed in an aeronautical environment.

The dielectric resonator element array (DRA) antenna system of the invention is well suited for use in a wide range of applications, particularly for data, voice and video satellite communications, and more particularly, for communication with Inmarsat satellites. However, the antenna system of the present invention is not limited to any particular uses or technological environments. FIG. 1 is a pictorial illustration of the DRA antenna system of the invention being employed in an aeronautical environment 10. An Inmarsat satellite 12 provides a communication link between a terrestrial transceiver 14 and an airplane 16 on which the DRA antenna system (not shown) is attached. It should be noted that the DRA antenna system of the invention could also be employed on the satellite 12. It should also be noted that the DRA antenna system may be communicating with fixed or mobile terrestrial transmitters receivers as opposed to, or in addition to, communicating with satellites.

Figure 2:
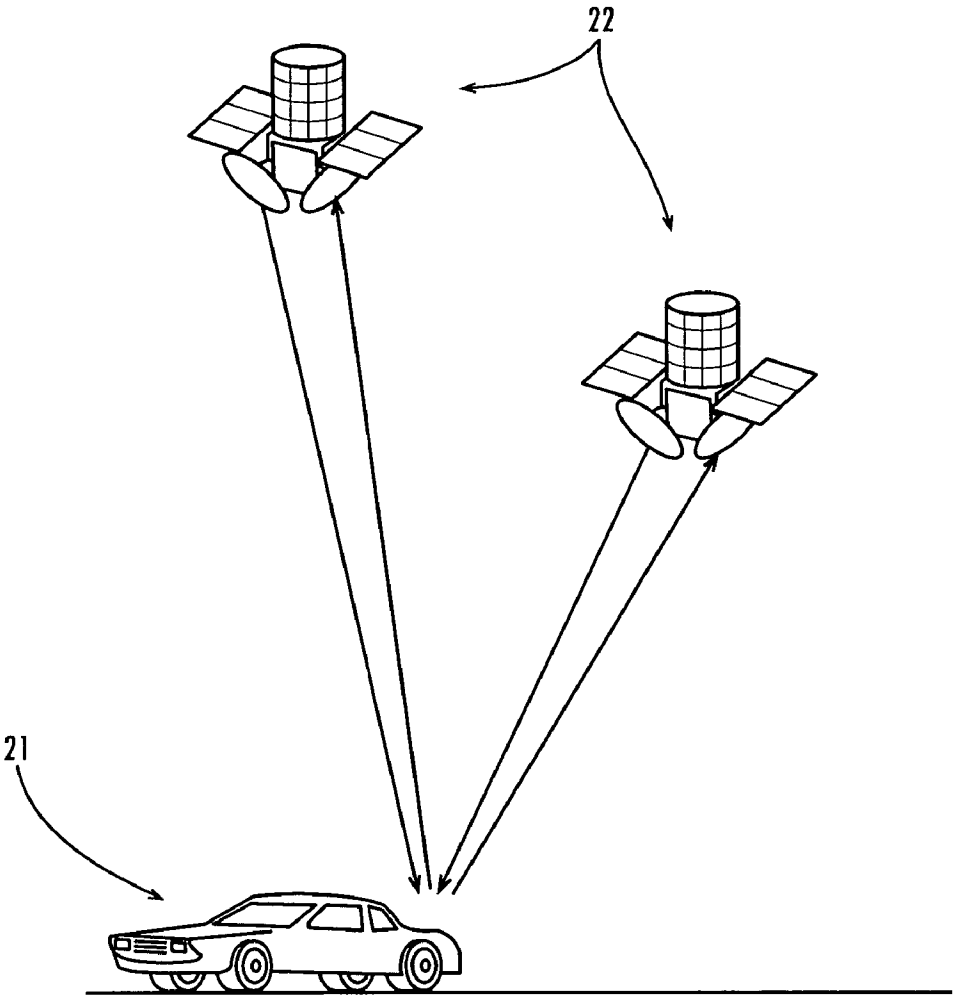
FIG. 2 is a pictorial illustration of the DRA antenna system of the invention attached to an automobile to provide a communication link between the automobile and one or more satellites.

FIG. 2 is a pictorial illustration of the DRA antenna system (not shown) attached to an automobile 21 to provide a communication link between the automobile 21 and multiple satellites 22. The DRA antenna system may be employed in other environments such as, for example, on recreational vehicles (RVs), ships, trains, buses, etc. However, because the DRA antenna system of the invention is particularly well suited for aeronautical applications due to its low profile, compact size and beam steering capability, it will be described herein in relation to its use in such an environment.

As indicated above, large antenna systems on aircraft can increase drag, weight, cause lightning strikes and other safety problems, and degrade the aircraft's appearance. System specifications, such as that of the Inmarsat Aeronautical System Definition Manual (SDM), place specific demands on performance that can lead to a large antenna structure. The invention provides a much smaller aeronautical antenna system while still satisfying such performance requirements. The compact nature of the DRA antenna system of the invention is achievable due to a variety of features, including:

1) Low-profile dielectric resonator radiating elements;
2) Unique pattern synthesis implementation;
3) A compact mounting device that does not add to the array size and helps to minimize edge diffraction effects;
4) A radome that is close to, or in direct contact with, the radiating elements; and
5) An optimal array grid.

These features of the invention allow the DRA antenna system to have a reduced height and width relative to known systems, which results in reduced aeronautical drag, the ability to install the antenna system in a very small area without excessive gap under the array element plane, and improved beam control.

Figure 3:
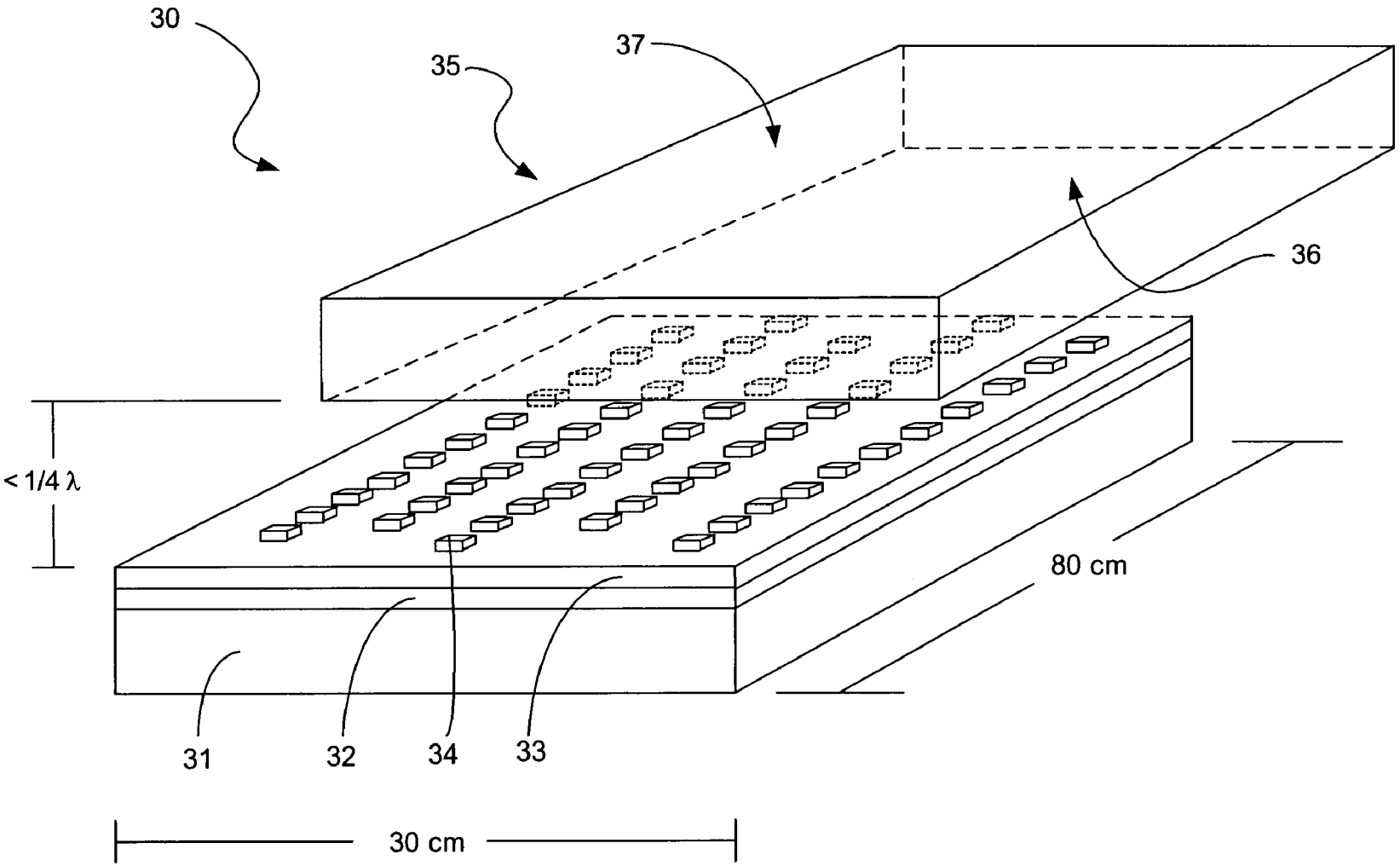
FIG. 3 is a perspective view of the DRA antenna system of the present invention in accordance with an embodiment.

FIG. 3 is a perspective view of the DRA antenna system 30 of the present invention in accordance with an embodiment. In accordance with this embodiment, the DRA antenna system 30 comprises a ground plain 31, a microwave feed layer 33, a dielectric substrate 32 interposed between the ground plain 31 and the microwave feed layer 33, dielectric resonator radiating elements 34 arranged in an array, and a radome 35 in contact with, or in close proximity to, the radiating elements 34. The radome 35 is secured in position by attachment devices, embodiments of which are described below in detail with reference to FIGS. 6 and 7.

The compact nature of the DRA antenna system 30 shown in FIG. 3 is demonstrated by the dimensions shown in FIG. 3. Although the invention is not limited to any particular dimensions, the dimensions shown in FIG. 3 are in the preferred range. In accordance with this embodiment, the dimensions are 80 centimeters (cm) in the length-wise direction and 30 cm in the width-wise direction. The distance between the upper surfaces of the elements 34 and the bottom side 36 of the top surface 37 the radome 35 preferably is approximately ¼λ, where λ is the transmission wavelength. Because the bottom side 36 of the top surface 37 of the radome 35 is so close to, or in contact with, the radiating elements 34, the effect of the radome 35 on the radiation pattern generated by the antenna system typically will be taken into account in the algorithm that controls generation of the radiation patterns and beam steering.

Typically, the dielectric elements 34 have a relatively high permittivity (i.e., higher than that of free space and preferably substantially higher), low conductivity and low loss tangent. The high permittivity of the dielectric elements 34 enables the size of the elements to be kept small. In an embodiment, each the dielectric elements 34 is made of a plastic base filled with a ceramic powder. The plastic material typically will be delivered in the form of a cured slab, although the material also comes in the form of a liquid or gel, which also may be used directly. The dielectric elements 34 may be attached to the upper surface of the microwave feed layer 33 by various materials (not shown), including, for example, a Cyanoacrylate adhesive, plastic resin with embedded ceramic particles, or mechanical fasteners.

The dielectric elements 34 may be arranged in a variety of configurations, including, for example, a triangular grid, a rectangular grid, and non-uniform grids. Although the elements 34 are shown arranged in a rectangular array of parallel rows of the elements 34, the transmission line structures in the feed layer 33 are capable of being varied so the electrical paths that connect the elements together are arranged in such a way that various array patterns can be achieved. In addition, although the individual elements 34 are shown in FIG. 3 as being rectangular parallelepiped in shape, other shapes are readily usable, such as, for example, hemispherical or pyramidal shapes. The only limitation on shape is that the dielectric resonator element be at, or near, resonance, when tuned by the path or transmission line structure of the feed layer 33, in one or more resonant modes, at the frequency, or frequency band, of operation.

Figure 4:
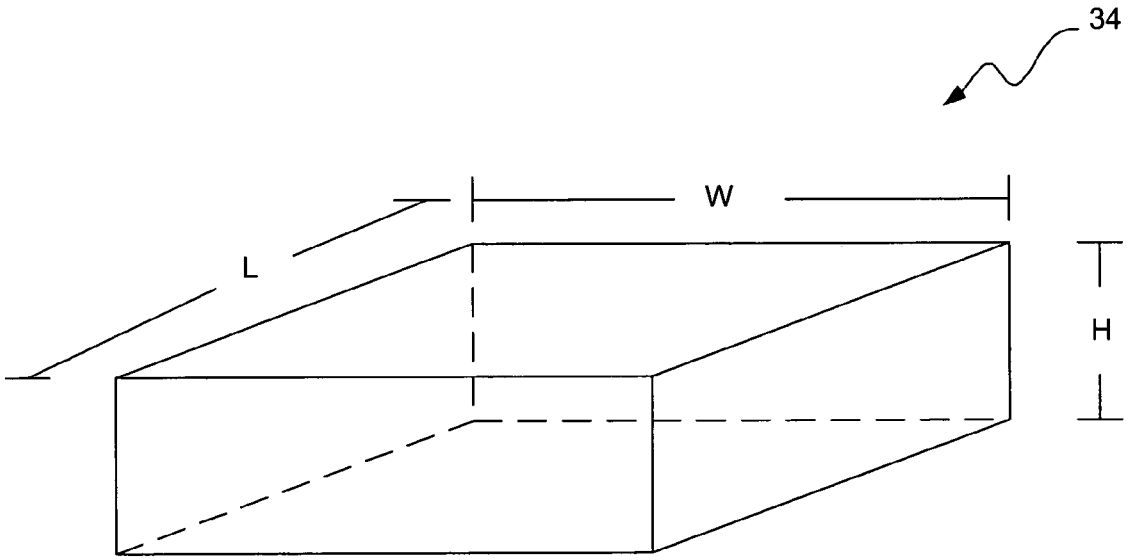
FIG. 4 is a perspective view of a dielectric resonator array element of the DRA antenna system in accordance with an embodiment, wherein the element is rectangular in shape.

If the DRA antenna system 30 is to radiate circular polarization or have two orthogonal polarisations in the same operating band, then the resonator could have 90° rotational symmetry in order that the impedance matching and pattern characteristics for the two orthogonal polarization components will be similar. For example, with reference to FIG. 4, the length (L) and width (W) of the element 34 may be equal. Each of the dimensions L, W, and H typically are considerably less than one-half of a free-space wavelength. Often, one or more of the dimensions L and W will be just under one-half of the wavelength in the dielectric material comprising the elements 34.

The microwave feed layer 33 preferably incorporates phase control devices (not shown) that allow the phase lengths between the individual elements 34 and the antenna system input and/or output ports (not shown) to be independently varied. Alternatively, the path lengths are varied in a manner dependent on introductions of phase distributions consistent with the desired radiation pattern. Multiple feed structures may couple into the dielectric elements 34 in order to produce multiple beams. Active gain devices (not shown) such as amplifiers may be inserted between the dielectric elements 34 and the feed or feeds in order to maximize efficiency. Such active gain devices may be on either side of the phase control devices. Devices to control the relative signal strength (amplitude control devices) to and/or from the individual elements 34 may also be included.

Figure 5:
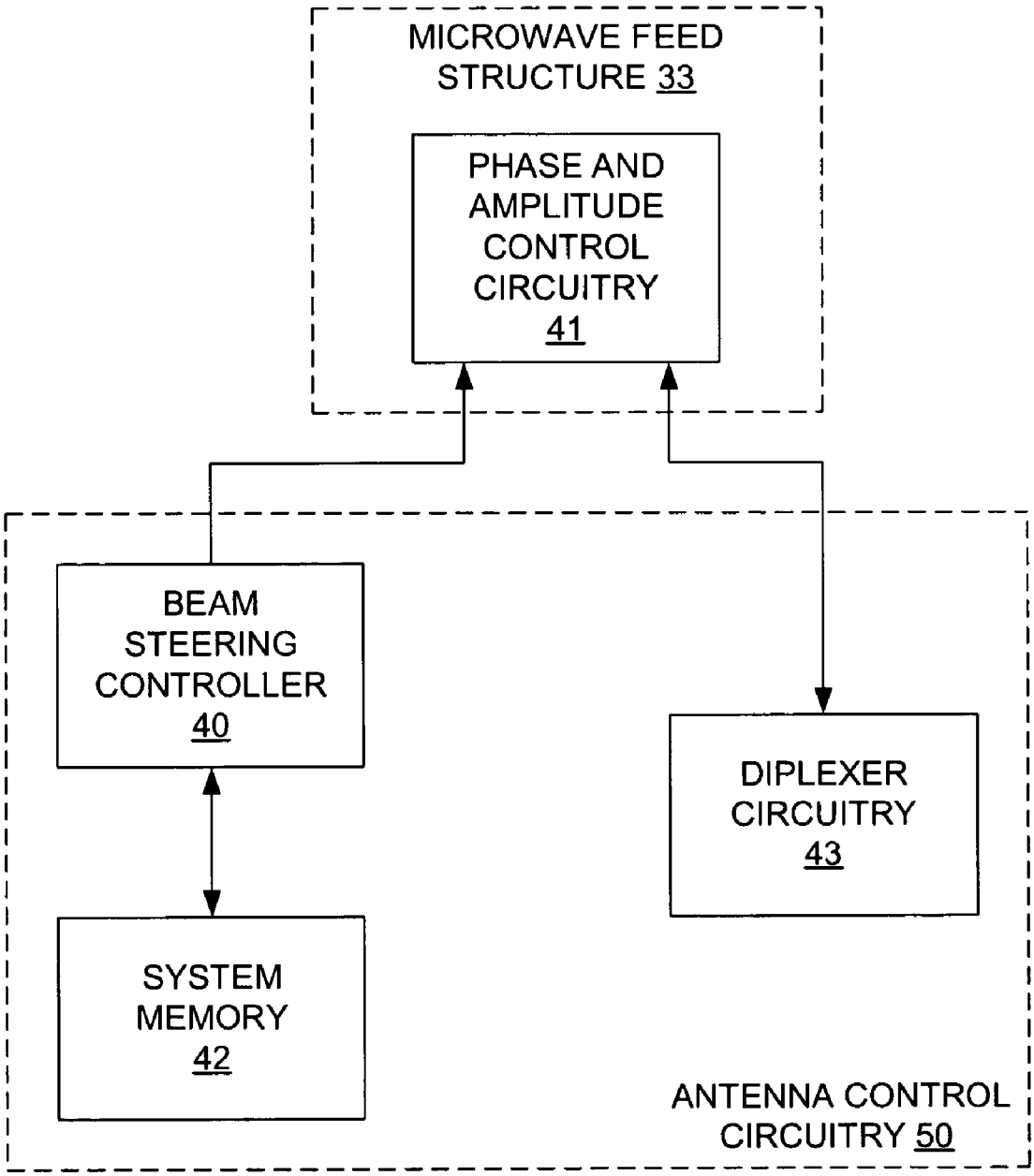
FIG. 5 is a block diagram of the DRA antenna control circuitry of the invention in accordance with an embodiment.

The phase control devices and/or amplitude control devices of the microwave feed structure are connected to the beam steering controller 40, as shown in FIG. 5. FIG. 5 is a functional block diagram of the electrical control circuitry 50 of the present invention in accordance with the preferred embodiment. The beam steering controller 40 provides signals to the aforementioned phase and amplitude control devices 41 of the transmission line structures of the feed layer 33 in order to produce the desired array radiation pattern or patterns. In particular, the controller 40 may provide signals that produce the pattern with the optimal trade-off between gain in the direction of an intended satellite that will be used for communications and interference in the direction of satellites and/or receivers that are not being used.

The controller 40 of the present invention is capable of producing a wide variety of beam shapes for any pointing angle (i.e., the direction of the desired satellite and thus also the nominal beam peak) relative to the object on which the antenna 30 is mounted (e.g., an airframe). For example, if interference with other satellites along the geostationary arc is of concern, then the beam shape can be synthesized or optimized for minimum gain along this arc except in the direction of the desired satellite. The control signals preferably are computed by real-time pattern synthesis using parameters such as, for example, aircraft latitude, longitude, orientation, location of the satellite of interest and/or locations of satellites for which interference is to be minimized. This is in contrast to prior art techniques that rely on reading prestored values from a lookup table.

In the case where the antenna system is used in an aeronautics environment, the positions of the interfering satellites relative to the airframe are a function of the aircraft location and orientation for any given pointing direction relative to the airframe. The prior art techniques, which use prestored values from a lookup table to control beam steering, do not take the positions of interfering satellites into account in shaping and steering the beam. The real-time pattern synthesis or optimization of the present invention enable such factors to be taken into account in beam shaping and steering. Block 42 in FIG. 5 represents system memory, which stores one or more algorithms that are executed by the controller 40 to perform real-time pattern synthesis or optimization. System memory 42 may also store data used by the controller 40 when executing these algorithms.

The beam steering controller 40 may incorporate one or more external navigation/attitude sensors as a supplement to, or as an alternative to, other means by which the antenna beam can be steered towards the desired satellite. For example, the beam steering controller 40 may use inputs from one or more accelerometers, inclinometers, Inertial Navigation System (INS), Inertial Reference System (IRS), Global Positioning System (GPS), compass, rate sensors or other devices for measuring position, acceleration, motion, attitude, etc. These may be devices that are used for other purposes on the aircraft or that are installed specifically for the purpose of assisting in the steering of the antenna beam.

The diplexer circuitry 43 provides isolation between the transmission (TX) and reception (RX) frequency bands. This may be achieved by way of, for example, filtering, microwave isolators, nulling or some combination of these or other mechanisms. The diplexer circuitry 43 may have an integral low noise amplifier (not shown) in the reception path such that the losses between the isolation device and the low noise amplifier are minimized, which, consequently, maximizes the system G/T. As stated above, the antenna system of the invention also may be operated in a half-duplex mode, may utilize a circulator, signal processing and/or some other mechanism to separate transmit and receive signals, thus making the diplexer circuitry 43 unnecessary in these alternative configurations.

The radome 35 shown in FIG. 3 protects the array of dielectric resonator elements 34 from the environment and preferably is relatively transparent to electromagnetic radiation. Typically, the radome 35 would be fabricated from a composite of reinforcing fibre and resin, or manufactured from a plastic material. The radome 35, in the case where the antenna system is being used as an aeronautical antenna system, also influences the radiation from the array of dielectric resonator elements 34 and matching of the dielectric resonator elements 34 due to its close proximity to these elements 34. Thus, the effect of the radome 35 on beam shaping and steering preferably is taken into account by the pattern synthesis or optimization algorithms executed by the beam steering controller 40. The radome 35 preferably is designed such that the composite performance of the elements 34 and radome 35 together is optimized. This design process is accomplished through optimization of the dimensions of both the elements 34 and the radome 35, and is facilitated by the use of full-wave electromagnetic analysis tools.

Figure 6:
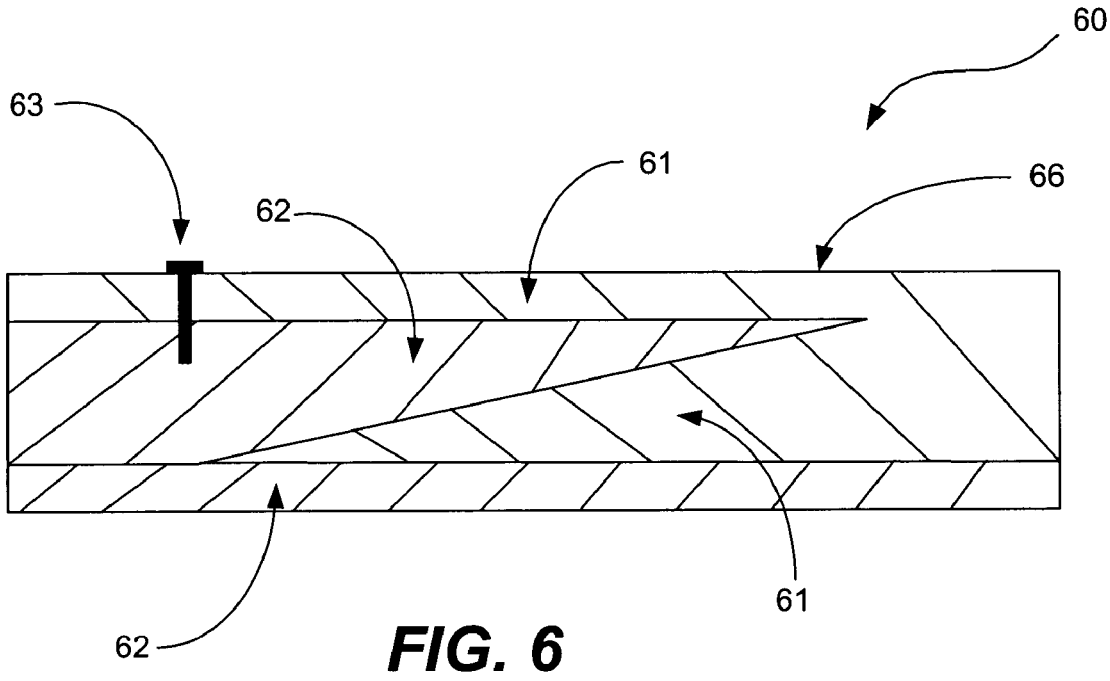
FIG. 6 is a side view of the mounting mechanism of the invention in accordance with an embodiment for mounting the DRA antenna system to a surface.
Figure 7:
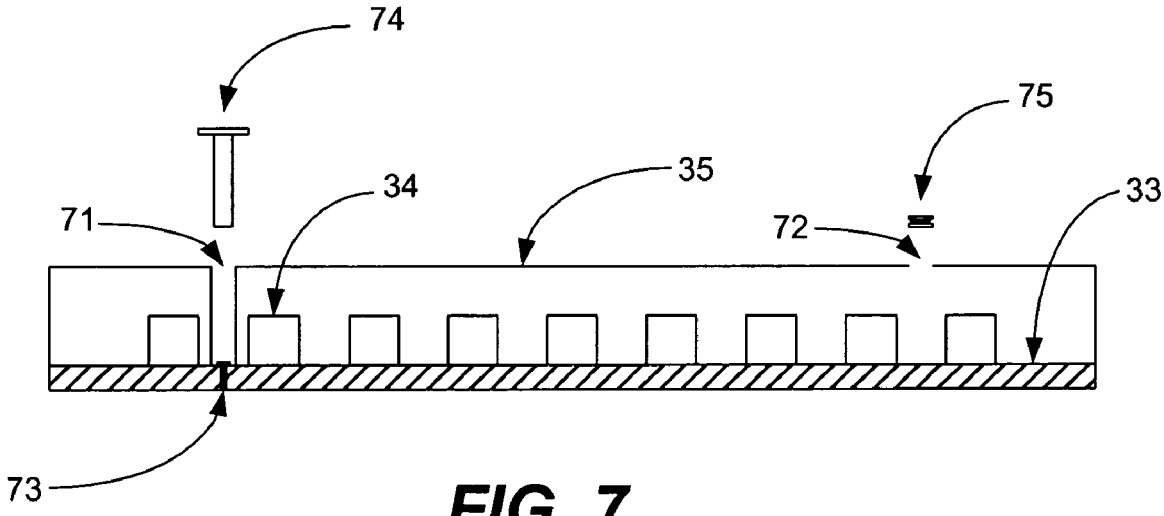
FIG. 7 is a side view of the mounting mechanism of the invention in accordance with another embodiment for mounting the DRA antenna system to a surface.

FIGS. 6 and 7 show side views of two different example embodiments of the compact mounting device of the present invention. The compact mounting devices of both embodiments attach the antenna system 30 shown in FIG. 1 to the mounting surface (e.g., an airframe) without increasing the size of the antenna system 30 appreciably beyond that of the radiating structure of the array of dielectric resonator elements 34 itself. With prior art antenna systems, the mounting hardware is predominantly outside of the perimeter of the radiating structure. Consequently, the overall size of the array in such systems is increased through the addition of the mounting hardware. In particular, prior art systems typically use a flange about the perimeter of the array through which machine screws can be passed. Often, but not always, the radome in prior art systems has a similar flange and mounting hardware passing through the radome and array base.

In the embodiment shown in FIG. 6, the mounting device 60 is a sliding jam-clamp. This structure has an upper component 61 and a lower component 62. One of the two components, component 61 in the example shown, incorporates a wedge that jams into a mating area within the other component 62. In FIG. 6, the two components are shaded in different directions to enable them to be distinguished from each other. The wedge need not be triangular in cross-section. However, the triangular shape does work well for the intended purpose. Any number of these jam-clamps can be used in mounting the antenna system to the mounting surface, which will be referred to hereinafter as an airframe since the invention is particularly well suited for aeronautical applications. In addition, one or more pieces of anti-sliding hardware 63 are used to secure the antenna to the jam clamp, such as one or more screws, rivets or bolts, for example, to stop the sections of the jam-clamp(s) from separating. The lower component 62 may be attached to the airframe by similar attachment devices. The ground plane 31 of the antenna system 30 is secured to the upper surface 66 of upper clamp component 61.

In the embodiment shown in FIG. 7, the DRA antenna system 30 of the invention is attached to the airframe using mounting hardware that passes through the radome 35 into the airframe and attaches firmly to the top of the radome 35. Preferably, either indentations 71 openings 72 are formed in the radome 35 through which the mounting hardware 73 passes down into the feed structure 33. This arrangement allows short, metallic fasteners to be used that are secured tightly between the solid feed structure 33 level and the airframe or interface plate to be used as the mounting hardware 73. The hardware may secure into the interface (adapter) plate (not shown) or into the airframe itself. If the hardware secures into an interface plate, then this plate is separately secured to the airframe.

It should be noted that short metallic fasteners 73 have a much higher electromagnetic resonant frequency than longer fasteners. The resonant frequencies of the short fasteners 73 thus tend to be far above the operating frequency of the antenna system 30. Consequently, the short metal fasteners have very little impact on the radiation performance of the antenna system 30. The lower position of the fasteners 73 (e.g., below the dielectric resonator elements 34) further ensures that the fasteners 73 are not strongly excited with microwave currents that could affect the radiation patterns or impedance characteristics of the array elements 34 or overall antenna system 30.

Typically, the indentations 71 or openings 72 in the radome 35 will be filled for environmental reasons. Precipitation should be kept out of the radome 35 and indentations or openings, and drag they create, should be minimized. This can be achieved by filling the indentations 71 or openings 72 with plugs 74 and 75, respectively. The plugs 74 or 75 can snap into the indentations or openings 72 or be bonded into place to fill the indentations 71 or openings 72 to thereby minimize drag. Of course, other types of attachment mechanisms are also suitable for this purpose. A flexible adhesive such as RTV, for example, may be suitable for securing the plugs in place, as this allows later removal of the plugs and thus of the mounting hardware and of the antenna system itself.

Figure 8:
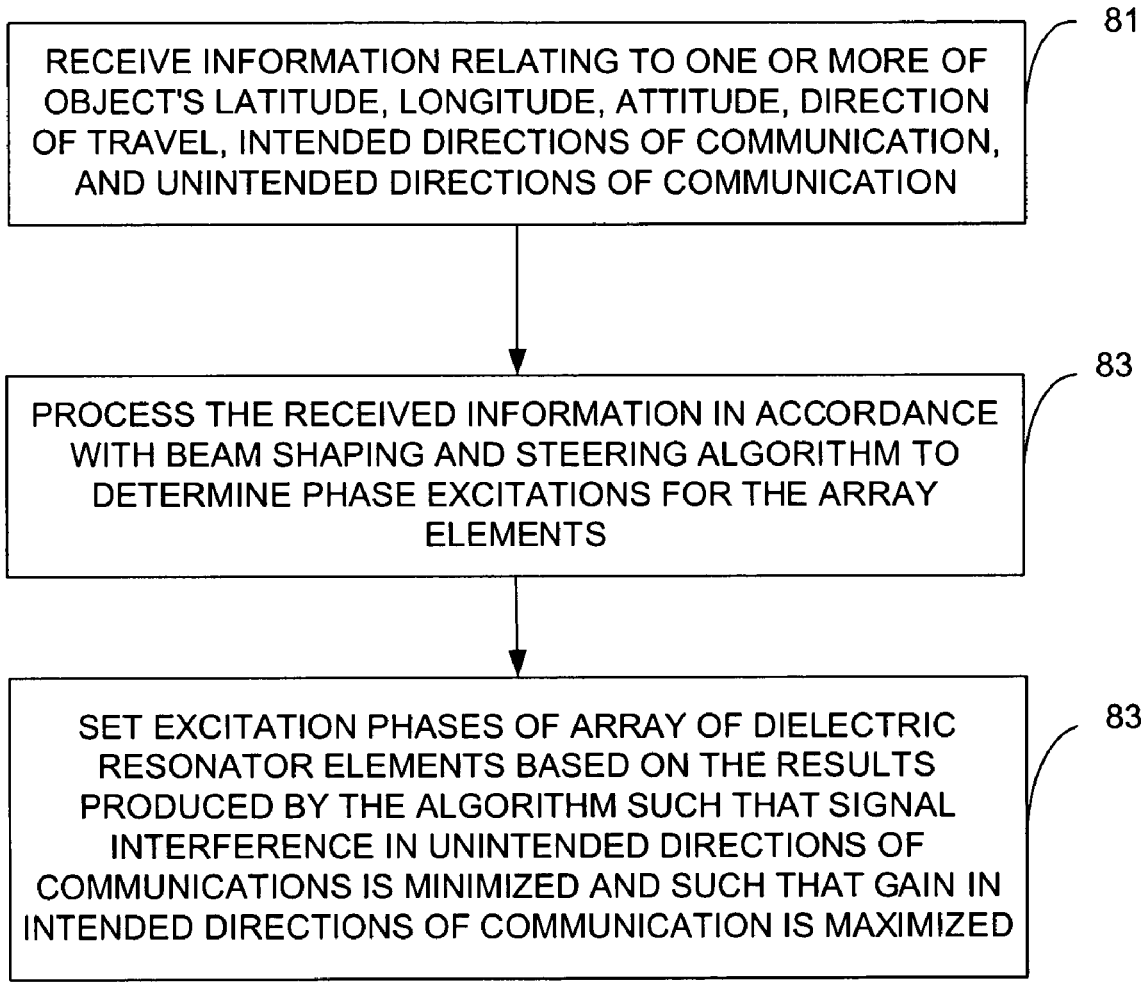
FIG. 8 is a flow chart of the method of the invention in accordance with an embodiment.

FIG. 8 is a flow chart of the method performed by the beam steering controller 40 shown in FIG. 5. The controller 40 receives information relating to one or more of the following: object latitude, longitude, attitude, direction of travel, intended directions of communication and unintended directions of communication. This step is represented by block 81. The controller 40 then processes the information in accordance with a beam shaping and steering algorithm executed by the controller 40 to determine the phase excitations for the array elements 34. This step is represented by block 82. The controller 40 then outputs signals to the phase and amplitude control circuitry 41 (FIG. 5), which set the phase excitations of the elements 34 accordingly.

The present invention has been described with reference to certain exemplary embodiments. The present invention is not limited to the embodiments described herein. It will be understood by those skilled in the art that modifications can be made to the embodiments described herein without deviating from the present invention. All such modifications are within the scope of the present invention.

What is claimed is:

1. A dielectric resonator antenna system comprising: a ground plane; a feed structure; an array of dielectric resonator elements electrically coupled to the feed structure, each dielectric element having a relatively high permittivity; a radome close to or in contact with the array of dielectric resonator elements; an object mounting apparatus for mounting the antenna system on the object; and a beam shaping and steering controller, the beam shaping and steering controller controlling the feed structure to thereby control excitation phases of the dielectric resonator elements.

2. The dielectric resonator antenna system of claim 1, wherein the permittivity of the array elements is higher than that of free space, the elements having low conductivity and low loss tangent.

3. The dielectric resonator antenna system of claim 1, wherein the array elements are substantially rectangular parallelepiped in shape.

4. The dielectric resonator antenna system of claim 1, wherein the array elements are arranged on a nominally planar surface.

5. The dielectric resonator antenna system of claim 1, wherein the array elements are arranged in a nominally triangular grid.

6. The dielectric resonator antenna system of claim 1, wherein the elements are configured dimensionally such that the antenna system performs optimally with the resonators close to or in contact with the array.

7. The dielectric resonator antenna system of claim 1, wherein the controller sets the excitation phases of the elements such that interference in specific directions or regions is minimized.

8. The dielectric resonator antenna system of claim 1, wherein the controller receives information relating to the object on which the antenna system is mounted and uses the information to set excitation phases of the array elements, the information including one or more of object latitude, longitude, attitude, direction of travel, intended direction of communication and unintended directions of communication.

9. The dielectric resonator antenna system of claim 8, wherein the intended direction of communication is in a direction of a satellite with which communication is desired.

10. The dielectric resonator antenna system of claim 8, wherein the unintended directions are in directions of satellites with which communication is undesired.

11. The dielectric resonator antenna system of claim 8, wherein the antenna system is mounted on a mobile platform.

12. The dielectric resonator antenna system of claim 8, wherein the antenna system is mounted on a mobile platform selected from the group comprising an aircraft, a ship, a train, an automobile and a recreational vehicle (RV).

13. The dielectric resonator antenna system of claim 12, wherein the controller receives navigational and/or attitude input from navigational and/or attitude aids on the aircraft and uses the received information to set the excitation phases of the array elements.

14. The dielectric resonator antenna system of claim 1, wherein the controller receives information from one or more of an accelerometer, an Inertial Navigation System (INS), an Inertial Reference System (IRS), a global positioning system (GPS) receiver, and an inclinometer.

15. The dielectric resonator antenna system of claim 1, wherein the mounting apparatus comprising a sliding jam-clamp having a first portion and a second portion, the first portion being attached to the antenna system and the second portion being attached to the object, the first and second portions being configured to slidably engage each other in a friction-fit mating configuration, and wherein the mounting apparatus does not appreciably increase the size of the antenna system.

16. The dielectric resonator antenna system of claim 1, further comprising: mounting hardware that passes through an opening or indentation in the radome and attaches to the array, and wherein the hardware, when attached, does not extend significantly beyond base portions of the array elements and consequently does not interfere with radiation characteristics of the antenna system.

17. The dielectric resonator antenna system of claim 1, wherein the controller executes a beam steering algorithm that takes into account information including one or more of object latitude, longitude, attitude, direction of travel, intended direction of communication and unintended directions of communication.

18. The dielectric resonator antenna system of claim 17, wherein the controller receives the information in real-time and sets the excitation phases in real-time as the information is processed in accordance with the beam steering algorithm being executed by the controller.

19. The dielectric resonator antenna system of claim 18, wherein the algorithm controls the beam shape such that a best possible trade-off between gain in the intended direction of communication and interference in the directions of unintended communication is achieved.

20. The dielectric resonator antenna system of claim 1, wherein the array elements each comprise a plastic base filled with a ceramic powder.

21. The dielectric resonator antenna system of claim 1, wherein the array elements are attached to a substrate of the feed structure by a Cyanoacrylate adhesive.

* * * * *